US005097105A

United States Patent [19]

Boin et al.

[11] Patent Number: 5,097,105

[45] Date of Patent: Mar. 17, 1992

[54] DEVICE FOR CONTROLLING THE POWER OF A MICROWAVE OVEN

[75] Inventors: Bernard Boin; Pierre Brisard, both of Saint-Lo, France

[73] Assignee: Moulinex (S.A.), Bagnolet, France

[21] Appl. No.: 471,519

[22] Filed: Jan. 29, 1990

[30] Foreign Application Priority Data

May 12, 1989 [FR] France ..... 89 06300

[51] Int. Cl.[5] ..... H05B 6/68

[52] U.S. Cl. ..... 219/10.55 B; 219/10.55 C; 200/38 B; 200/38 FA

[58] Field of Search ..... 219/10.55 B, 10.55 C, 219/492, 493; 200/38 B, 38 C, 38 CA, 38 FA

[56] References Cited

U.S. PATENT DOCUMENTS

| | | | |
|---|---|---|---|
| 4,129,769 | 12/1978 | Takagi et al. | 219/10.55 B |
| 4,133,998 | 1/1979 | Otani | 219/10.55 B |
| 4,177,370 | 12/1979 | Otani | 219/10.55 B |
| 4,551,590 | 11/1985 | Mahon | 200/38 B |
| 4,629,845 | 12/1986 | Mahon | 219/10.55 B |
| 4,678,930 | 7/1987 | Mahon | 200/38 FA |

FOREIGN PATENT DOCUMENTS

| | | |
|---|---|---|
| 786490 | 9/1935 | France . |
| 2082528 | 12/1971 | France . |
| 898037 | 6/1962 | United Kingdom . |

*Primary Examiner*—Philip H. Leung

*Attorney, Agent, or Firm*—Young & Thompson

[57] ABSTRACT

Control device for microwave ovens comprising a timer whose movement (1) drives a periodic actuating mechanism of the actuator (2) of a switch (3), mounted in the electric supply circuit of the oven, as well as a selector (4) of operating modes manipulable by the user and adapted to influence the actuation mechanism so as to modify the open and closed periods of the switch (3) so as to obtain different modes of cooking. The periodic actuation mechanism comprises an actuator (5) which is movably mounted against a spring (6) with reciprocatory movement and which carries a cam (7) adapted to act on the actuator (2) of the switch (3). A cylinder (8) is driven in rotation by the timer and is slidably axially along its axle (9) of rotation by a transmitter (10) in contact with the mode selector (4). A toothed region (11) carried by the actuator (5) temporarily engages at least one toothed region (12) on the side surface of the cylinder (8). The cylinder teeth are circumferentially spaced and extend parallel to the axle (9) of the cylinder (8) by progressively different lengths, thereby defining a multiplicity of toothed peripheral paths (P1, P2 . . . ) having respectively different arcuate lengths as a function of their location along the length of the cylinder (8). The duration of engagement of the cylinder (8) with the actuator (5) and hence the on or off time of the oven will be a function of the position of the cylinder (8) along its axle relative to the actuator (15) as determined by the mode selector (4).

5 Claims, 1 Drawing Sheet

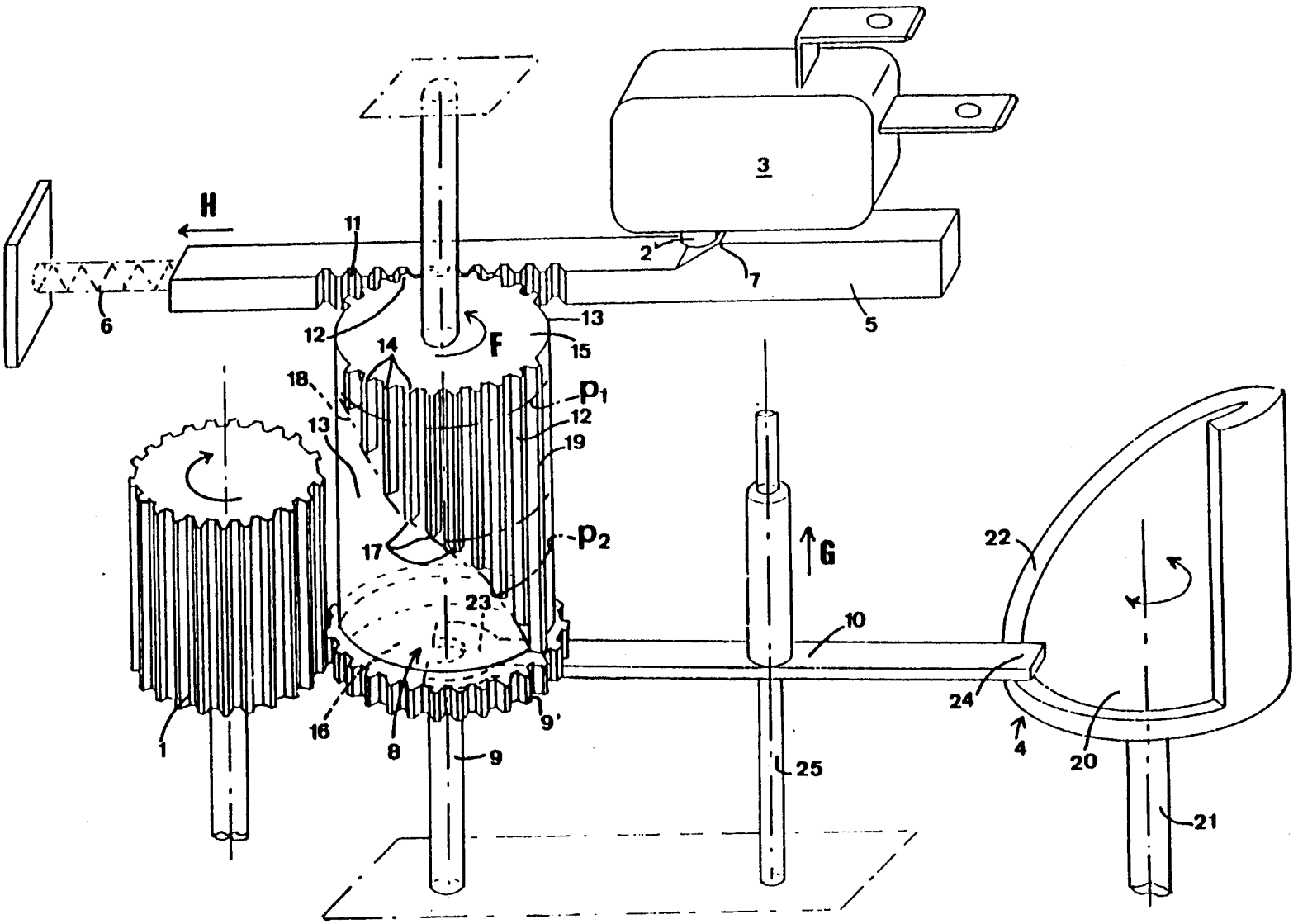
3
2
7
5
6
H
11
12
14
18
13
15
F
P1
12
19
P2
17
23
9'
9
8
16
1
G
10
25
24
22
20
21
4

DEVICE FOR CONTROLLING THE POWER OF A MICROWAVE OVEN

The invention relates to devices for controlling the power of microwave ovens comprising a timer whose movement drives a periodic actuating mechanism of the actuator of a switch mounted in the electric feed circuit of the oven, as well as selector means for the operational modes manipulable by the user and adapted to influence the actuating mechanism so as to modify the open and closed periods of the switch so as to obtain different cooking modes.

The devices of this type are generally made, for reasons of size and precision, according to so-called watchmaking technique, which is to say comprising parts that are relatively small (for example a cam with compound profile). Moreover, the interconnection between the actuating mechanism and the selector means should be reliable and strong because it must be manipulated by the user. These various requirements therefore involve high cost of manufacture.

The invention has for its object to simplify the construction of these devices so as to be able to mass produce them at a low price.

According to the invention the periodic actuating mechanism comprises an actuator which is movably mounted under the influence of elastic means for reciprocatory movement and which bears a cam adapted to come into engagement with the actuator of the switch, as well as a cylinder which is driven in rotation by the timer and which is slidably mounted along its axis of rotation by means of a transmitter connected to the selection means of the modes, said actuator and said cylinder having respectively mutual temporary connecting means such as a toothed region carried by the actuator and at least a region of gearing provided on the lateral surface of the cylinder and comprising a series of teeth which are circumferentially spaced and which extend parallel to the axis of the cylinder along progressively different lengths, thereby defining a multiplicity of toothed peripheral tracks having respectively different lengths of arc as a function of their position on the height of the cylinder, such that the duration of engagement of said cylinder with the actuator will depend on the position of the cylinder on its axle relative to the actuator.

Thus, such an engagement device provides a simple and strong construction, requiring no casting or high precision assembly and therefore permits reducing the cost of fabrication.

The characteristics and advantages of the invention will be further apparent from the description which follows, by may of example, with reference to the accompanying drawing in which:

The sole figure is a schematic view of a control device according to the invention.

As shown, the control device of the oven comprises a timer whose movement schematically shown for the output pinion 1 drives a periodic actuating mechanism of the actuator 2 of a switch 3, mounted in the electric supply circuit of the oven, as well as selector means 4 of the operating modes manipulable by the user and adapted to influence the actuating mechanism so as to modify the periods of closing and opening of the switch 3 so as to obtain the different modes of cooking.

The actuating mechanism comprises an actuator 5 constituted by a rack which is linearly movably mounted under the influence of elastic means such as a spring 6 for reciprocal movement and which bears a cam 7 adapted to act on the actuator 2 of the switch 3, as well a cylinder 8 which is driven in rotation about its axle 9 by means of a toothed wheel 9' and which is slidably axially mounted along said axle 9, by means of a transmitter 10 engaging the selector means 4, said rack 5 and said cylinder 8 having respectively mutual temporary interconnecting means such as the toothed region 11 of the rack and two toothed regions 12 provided on the lateral surface of the cylinder 8 and diametrically opposite each other, thereby leaving between them two plain regions 13.

Each region 12 comprises a series of teeth which are circumferentially spaced and which extend parallel to the axle 9 of cylinder 8 for progressively different lengths, thereby defining a multiplicity of toothed peripheral paths which have respectively different lengths of arc as a function of their position on the height of the cylinder 8, and of which for example there are shown in broken line two possible paths P1 and P2.

The teeth of each series have each a so-called base end 14 disposed in an arc at the edge of one 15 of the transverse faces 15, 16 of the cylinder 8 while the other so-called summit end 17 terminates on a helical line (schematically shown in broken line at 18) extending between the two faces 15 and 16 and extending from the end 1 of the shortest tooth to the end 17 of the longest tooth 19 in the direction of rotation of the cylinder (arrow F), this tooth 19 extending over practically all the height of the cylinder and leading in the direction of rotation of said cylinder.

The mode selector means comprise a cam 20 driven in rotation by a control shaft 21 manipulable by the user and mounted parallel to the axle 9 of the cylinder 8 and comprising an active portion 22 extending along a helix coaxial with said control shaft. The transmitter 10, having the shape of a fork, comprises a forked end 23 which surrounds the axle 9 and which bears against face 16 of the cylinder, while the other end 24 bears on the active part 22 of said cam, the transmitter being mounted slidably on an axle 25 secured to the casing of the timer and also parallel to the axle 9 of said cylinder 8.

The control device thus constituted operates in the following manner. Let it be assumed that the user manipulates the control shaft 21 to bring the cam 20 into the position of FIG. 1. In the course of this rotative movement, the transmitter 10 bearing with its end 24 on the active portion 22 is caused to slide in the direction of arrow G along the axle 25 and displaces the cylinder 8 by its forked end 23 guided along the axle 9 to bring it to the height shown. The rotation of the cylinder in the direction of arrow F therefore brings the path Pl, which comprises the greatest number of teeth, into engagement with the rack thereby causing its translation against the spring 6 (arrow H). Thanks to this translation, the cam 7 acts on the actuator 2 of the switch which, from its rest position corresponding to the closure of the supply circuit of the magnetron, passes to its open position thereby cutting said supply, and maintains this open position as long as the rack is in mesh with the path P1.

When one of the blank regions 13 arrives opposite the rack and the last tooth of the path Pl escapes from this rack, the latter is pressed back by the spring 6 so as to resume its rest position in which the actuator 2 is released and the switch 3 is closed.

Thus, thanks to the continuous rotation of the cylinder 8 there is obtained a series of reciprocations of the rack 5 which defines the open and closed positions of the switch 3 and thus the power of the oven.

When the user desires to change the cooking mode and therefore to modify the power of the oven, he acts on the control shaft 21 so as to make the cylinder 8 slide along the axle 9 to a different level relative to the rack. Let it be supposed that the cylinder 8 is brought to a level corresponding to the path illustrated at P2 (P2 comprises four teeth while P1 comprises ten), it will be understood that the engagement of the rack and the cylinder is of a shorter duration than before because the number of teeth of this path is smaller and the rack will for a longer time confront one of the smooth regions 13 which extends, at this level, about an arc of greater length than the arc between the two paths P1. As a result, because the duration of closure of the switch 3 in its rest position is longer than before, the actuation period of the actuator 2 of the switch 3 is modified and thus the operating power of the oven is changed.

What is claimed is:

1. In a microwave oven having an electric supply circuit, a switch for actuating said electric supply circuit, a first actuator for actuating said switch, selector means of cooking modes manipulable by the user to actuate said first actuator so as to modify open and closed periods of said switch so as to obtain different modes of cooking, and a timer for setting a cooking time; the improvement comprising a second actuator movably mounted for reciprocatory movement relative to said first actuator, said second actuator having a cam that contacts said first actuator to operate said switch, spring means urging said second actuator in a first direction in which said cam is out of contact with said first actuator, a cylinder driven in rotation by said timer, an axle of rotation along which said cylinder is slidable, a transmitter for sliding said cylinder along said axle, said selector means transmitting movement to said transmitter to move said cylinder along said axle, said second actuator and said cylinder having respective temporary mutual engagement means in the form of a toothed region carried by said second actuator and at least one toothed region on a side surface of said cylinder and comprising a series of teeth which are circumferentially spaced and which extend parallel to said axle along progressively different lengths, thereby defining a multiplicity of toothed peripheral paths having respectively different arcuate lengths as a function of their location along the length of the cylinder, whereby the duration of engagement of said teeth of said cylinder with said teeth of said second actuator will be a function of the position of the cylinder along said axle as determined by said transmitter and hence as selected by said selector means.

2. Apparatus according to claim 1, in which said second actuator comprises a rack which is linearly movable in a direction transverse to said axle and on which a region adjacent to said toothed region of said second actuator bears said cam.

3. Apparatus according to claim 1, wherein said teeth on said cylinder each have an end disposed in an arc on the edge of an end face of said cylinder, each of the last-named teeth having an opposite end which terminates along a helicoidal line interconnecting two end faces of the cylinder and proceeding in the direction of rotation of the cylinder from the first-mentioned end of the shortest tooth to the second-mentioned end of the longest tooth on the cylinder, said longest tooth being the leading tooth of the teeth on the cylinder with respect to the direction of rotation of the cylinder.

4. Apparatus according to claim 1, in which said at least one toothed region of the cylinder comprises two diametrically opposed toothed regions spaced apart by smooth regions.

5. Apparatus according to claim 1, in which said selector means comprises a further cam driven in rotation by a control shaft parallel to said axle and comprising an active portion disposed on a helix extending coaxially of said control shaft, said transmitter having the form of a fork which comprises a forked end engaged with an end surface of said cylinder and an opposite end bearing against the active portion of said further cam, said transmitter being slidably mounted along a further axle which is parallel to the first-mentioned said axle.

* * * * *